US006655340B2

(12) United States Patent
Garza

(10) Patent No.: US 6,655,340 B2
(45) Date of Patent: Dec. 2, 2003

(54) ENGINE WITH BALANCER FOR SECOND ORDER PITCHING COUPLE

(75) Inventor: Michael Albert Garza, Clarkston, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/967,834

(22) Filed: Oct. 1, 2001

(65) Prior Publication Data

US 2003/0062015 A1 Apr. 3, 2003

(51) Int. Cl.[7] ..... F02B 75/06
(52) U.S. Cl. ..... 123/192.2
(58) Field of Search ..... 123/192.2, 192.1, 123/58.1

(56) References Cited

U.S. PATENT DOCUMENTS

| | | | | | |
|---|---|---|---|---|---|
| 3,710,774 | A | * | 1/1973 | Weseloh et al. | 123/192.2 |
| 4,729,351 | A | * | 3/1988 | Nishimura et al. | 123/192.2 |
| 4,802,450 | A | * | 2/1989 | Roberts | 123/192.2 |
| 5,791,309 | A | * | 8/1998 | Yamazaki et al. | 123/192.2 |
| 5,918,573 | A | * | 7/1999 | Killion | 123/192.2 |
| 6,205,970 | B1 | * | 3/2001 | Iwata et al. | 123/192.2 |
| 6,283,080 | B1 | * | 9/2001 | Tsunoda et al. | 123/192.2 |
| 6,286,474 | B1 | * | 9/2001 | Downs et al. | 123/192.2 |
| 6,305,339 | B1 | * | 10/2001 | Iwata et al. | 123/192.2 |
| 6,371,071 | B1 | * | 4/2002 | Iwata | 123/192.2 |
| 6,397,810 | B2 | * | 6/2002 | Ohyama et al. | 123/192.2 |

* cited by examiner

*Primary Examiner*—Henry C. Yuen
*Assistant Examiner*—Jason Benton
(74) *Attorney, Agent, or Firm*—Leslie C. Hodges

(57) ABSTRACT

An engine includes a balancer having dual, oppositely rotating balance shafts designed to provide oppositely rotating unbalance couples which combine to provide a pitching couple to the associated engine frame and which balances a pitching couple developed in the engine rotating and reciprocating components. First and second balance shafts mounted on opposite sides of the engine frame are driven in opposite rotation at twice crankshaft speed by a sprocket and chain drive at the rear end of the engine. The balance shafts each have longitudinally-spaced, oppositely facing balance weights that develop equal and oppositely rotating unbalance couples which combine to generate a vertical pitching couple equal to and opposing the second order pitching couple of the engine. In a preferred embodiment, the drive includes reversing gears that provide opposite rotation of one of the balance shafts. Additional features are included.

8 Claims, 3 Drawing Sheets

ENGINE WITH BALANCER FOR SECOND ORDER PITCHING COUPLE

TECHNICAL FIELD

This invention relates to reciprocating piston engines and more particularly to a balancer for balancing a second order pitching couple in such an engine.

BACKGROUND OF THE INVENTION

In the design of an inline five cylinder engine, it was recognized that the arrangement resulted in a second order vertical pitching couple acting on the engine frame as a result of the action of crankshaft rotation and the reciprocation of the connected reciprocating masses. In order to provide a smoother running engine, it was considered desirable to provide a suitable balancer for the engine to create an opposing couple that would balance out the pitching couple developed by the operating components of the engine.

SUMMARY OF THE INVENTION

The present invention combines with the engine a balancer having dual, oppositely rotating balance shafts that create oppositely rotating unbalance couples which combine to apply a vertical pitching couple to the associated engine frame that opposes and balances the pitching couple developed in the engine rotating and reciprocating components. While the balancer has been developed for a specific five cylinder engine arrangement, it could also be utilized in other engines in which an unbalanced pitching couple is present.

The balancer is driven by a sprocket carried adjacent the rear end of the engine crankshaft and engaging a chain which drives first and second driven sprockets. A first balance shaft is mounted to one side of the engine frame and is directly connected with the first sprocket for rotating the balance shaft in the direction of the crankshaft at twice crankshaft speed. A second balance shaft is mounted to an opposite side of the engine frame and is indirectly connected to the second sprocket through a reversing drive for rotating the second balance shaft in a direction opposite to that of the crankshaft and at twice crankshaft speed. The balance shafts each have longitudinally-spaced, oppositely facing balance weights that develop equal and oppositely rotating unbalance couples. These couples combine to generate a vertical pitching couple equal to and opposing the second order pitching couple of the engine.

In a preferred embodiment, the reversing drive includes a drive gear rotatable with the second sprocket and engaging a driven gear carried on the second balance shaft. The two gears provide the reversal of direction of the balance shaft to a rotation opposite that of the crankshaft and at twice crankshaft speed. Preferably, the gears are carried by a mounting plate on fixed centers and the mounting plate is made of a ferrous material similar to the gears to maintain a relatively constant gear backlash at various operating temperatures.

Because of the gear drive, the balance weights of the second balance shaft are designed with smaller diameters to provide a critical mass polar moment of inertia that avoids rotational vibrations in the shaft and resulting gear tooth mismotion and rattle during operation in the range of engine speeds. For this purpose, the balance weights of the second balance shaft are made longer and of smaller diameter than the balance weights of the first balance shaft. The first balance shaft has larger diameter weights and is shorter than the second balance shaft to minimize the space occupied by the first balance shaft.

The chain drive includes a chain tensioner to control chain motion during engine operation. The arrangement is such that the chain, the driven sprockets and the gear components are mounted on a rear wall of the engine frame and the drive sprocket is carried on the crankshaft adjacent a rear end thereof.

These and other features and advantages of the invention will be more fully understood from the following description of certain specific embodiments of the invention taken together with the accompanying drawings.

DESCRIPTION OF THE PREFERRED EMBODIMENT

Figure 1:
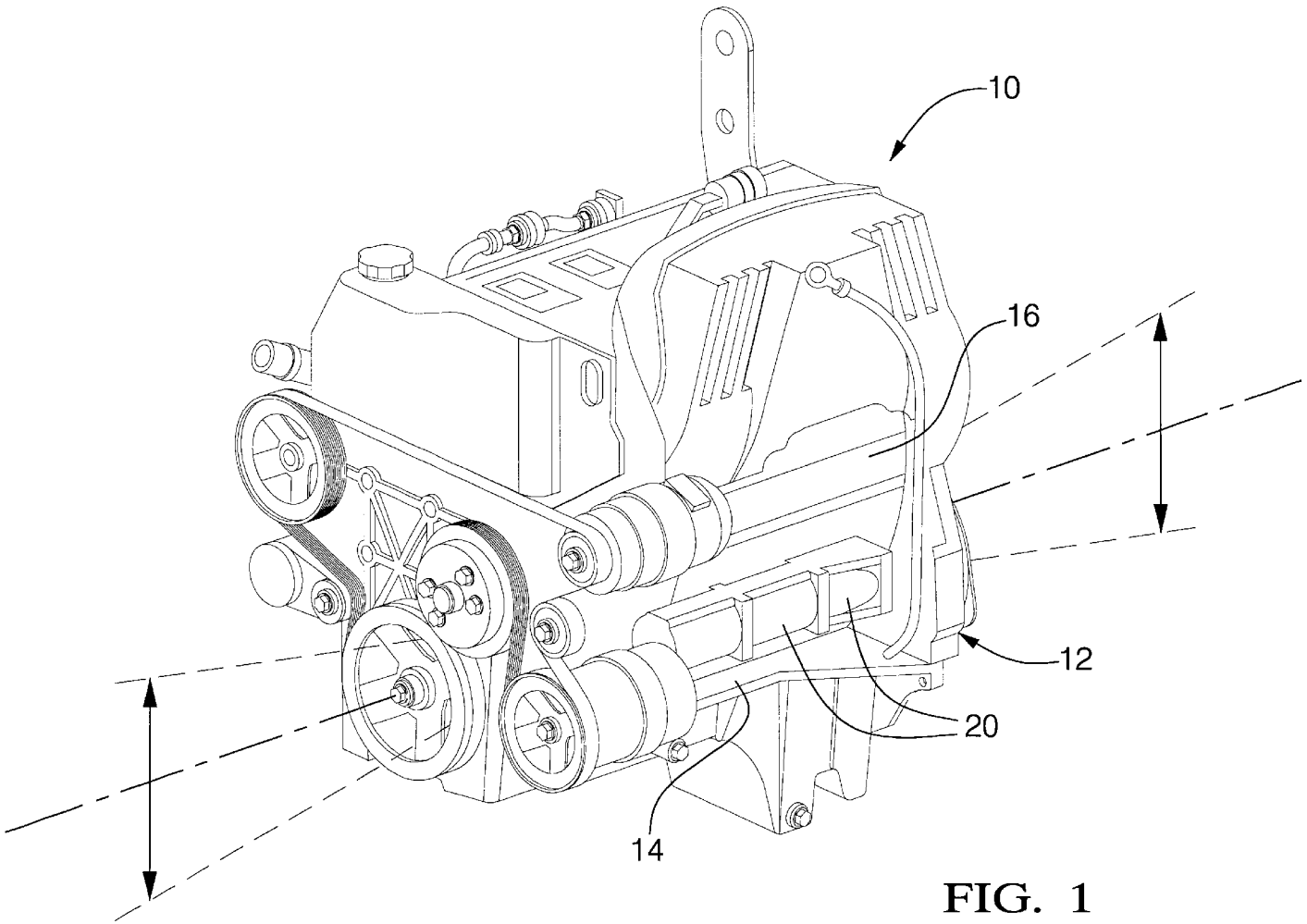
FIG. 1 is a front end and left side pictorial view of a five cylinder inline engine arrangement having a balancer according to the invention.

Referring now to the drawings in detail, numeral 10 generally indicates a five cylinder inline reciprocating piston internal combustion engine formed in accordance with the invention. Engine 10 has a frame 12 including a crankcase 14 conventionally mounting a crankshaft, not shown, and a cylinder block 16 internally containing cylinders, not shown, in which are reciprocated pistons connected by connecting rods with the crankshaft in a conventional manner.

Since the engine is an inline five cylinder with a 1-5-2-3-4 firing order and crankshaft pin configuration, the engine inherently develops an unbalanced secondary pitching couple operating in the vertical direction along the crankshaft axis. In order to offset this couple for a smoother running engine, a second order pitching couple balancer is provided generally indicated by numeral 18. Removable covers 20, shown along the right side of the engine crankcase in FIG. 1, are positioned to provide access to a portion of the engine balancer which is completely mounted within the interior of the engine 10 and so is not visible in FIG. 1

Figure 2:
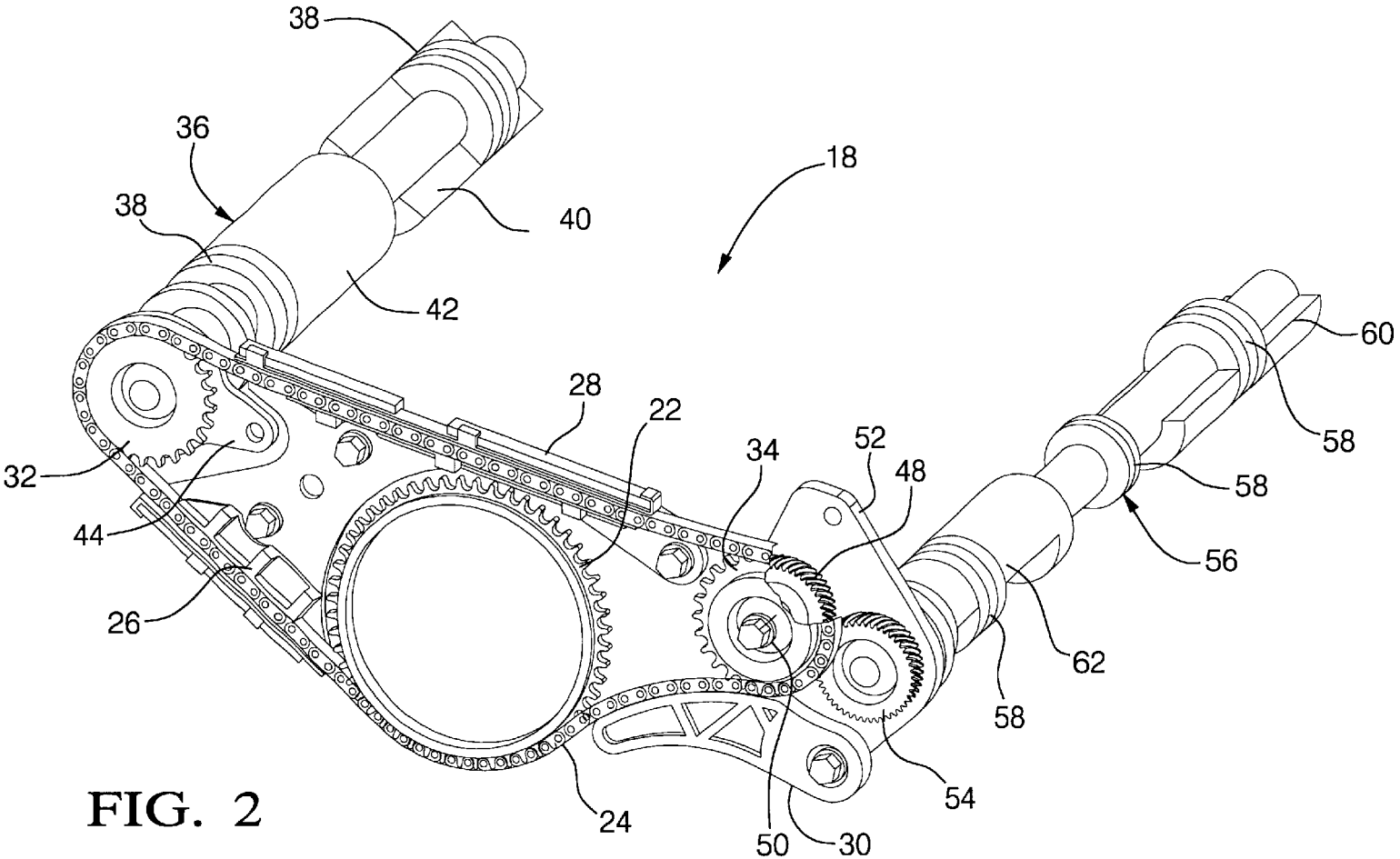
FIG. 2 is a pictorial view of the assembled components of the balancer shown in their positions when installed from the rear end of the engine of FIG. 1.
Figure 3:
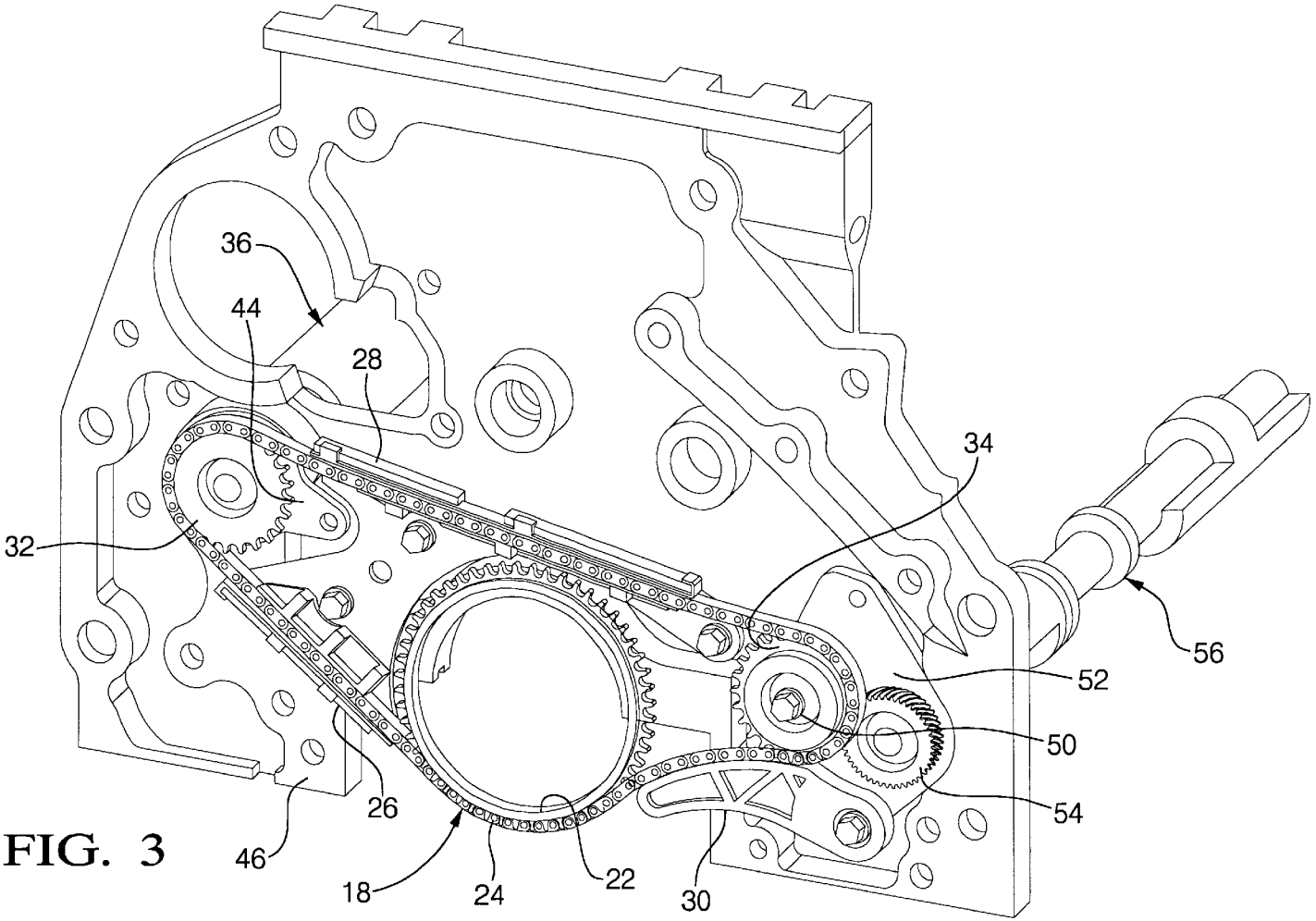
FIG. 3 is a pictorial view of the drive portions of the balancer of FIG. 2 shown in their mounted positions on a rear wall or bulkhead of the engine.

Referring to FIGS. 2 and 3 of the drawings, the balancer 18 includes a drive sprocket 22 which in assembly is mounted on and rotatable with the engine crankshaft adjacent a rear end thereof. Sprocket 22 engages a drive chain 24 that runs along guides 26 and 28 and is tensioned by a spring chain tensioner 30. The chain extends laterally in either direction from the sprocket 22 and engages a first driven sprocket 32 and a second driven sprocket 34.

The first sprocket 32 is directly connected to a first balance shaft 36 which includes bearing journals 38 supported in bearings not shown mounted to the left side wall of the engine frame 12. Shaft 36 includes front and rear balance weights 40, 42 which are offset from the shaft axis in opposite directions so as to create an unbalance couple rotating in the direction of crankshaft rotation and at a speed twice crankshaft speed by reason of sizing of the driven sprocket 32 at half the diameter of the drive sprocket 22. Balance shaft 36 and the connected drive sprocket 32 are supported at the rear end by a bracket 44 which in assembly is bolted to a rear wall 46 of the engine frame as shown in FIG. 3.

The second driven sprocket 34 is connected with a drive gear 48 which is rotatable with the second sprocket on a shaft 50 supported by a mounting bracket 52. Drive gear 48 engages a driven gear 54 also supported by bracket 52 with a fixed spacing from the drive gear 48. Gear 54 is directly connected to a second balance shaft 56 which also includes bearing journals 58 supported in bearings, not shown, mounted to the right side of the engine frame 12. Shaft 56 also carries balance weights 60, 62 which extend in opposite directions from the balance shaft axis and thus create when rotated a rotating unbalance couple which rotates at a speed twice crankshaft speed in a direction opposite to rotation of the crankshaft. The phasing of the balance weights on balance shaft 56 is such that the vertical forces add to one another and the lateral forces balance one another. The resulting unbalance force is a vertical rocking couple applied to the engine frame and timed in opposition to the rocking couple generated by the internal engine components so that the unbalanced engine couple is balanced by the balancer 18.

In order to minimize variations in the backlash of the drive and driven gears 48, 54, the bracket 52 is made of a ferrous material having a similar expansion coefficient to that of the gears. The gear center distances are thereby maintained essentially constant over a variety of operating temperatures of the engine.

It will be observed from the drawings that the length and diameters of the balance weights on shafts 36 and 56 are considerably different even though the rotating unbalance couples generated by the two shafts are identical. The left hand balance shaft 36 is made with shorter weights 40, 42 having larger diameters in order to shorten the length of the balance shaft so that it is more compact and occupies a smaller portion of the side wall of the engine for a more efficient mounting arrangement. The right hand balance shaft 56 is, on the other hand, made longer with longer balance weights 60, 62 having smaller diameters. This is done to reduce the polar moment of inertia of the right hand shaft below a critical mass polar moment of inertia to avoid a gear tooth mismotion or oscillation and audible gear rattle. Thus, extending the length of the shaft and balance weights with smaller diameter weights provides for a quieter drive of the rotation reversing gears and a better overall operation of the balancer.

While the preferred embodiment described uses a sprocket and chain drive and a gear reversing drive, equivalent components could be substituted where possible without departing from the concepts of the invention. For example, a belt could replace the chain and be connected with sprockets or gears. Other forms of reversing drives could also be employed. Thus, the terms chain, sprocket and gear as used in the claims are intended to include equivalent belt, sprocket and gear devices.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An engine comprising:

a frame mounting a crankshaft and reciprocating components in inline cylinders that together produce a second order pitching couple acting on the engine frame; and a balancer mounted to the engine for balancing the pitching couple when the engine is operating, the balancer including:

a drive sprocket carried by the crankshaft for rotation therewith;

a drive chain engaging the drive sprocket;

first and second driven sprockets engaged by the drive chain;

a first balance shaft mounted to one side of the engine frame and directly connected with the first sprocket for angular rotation in the direction of the crankshaft at twice crankshaft speed;

a second balance shaft mounted to an opposite side of the engine frame and indirectly connected to the second sprocket through a reversing drive for angular rotation opposite the direction of the crankshaft at twice crankshaft speed;

said balance shafts each having longitudinally-spaced, oppositely phased balance weights, the shafts developing equal oppositely rotating unbalance couples that combine to generate a vertical pitching couple equal to and balancing the second order pitching couple of the engine.

2. An engine as in claim 1 comprising a single cylinder bank with only five inline cylinders having reciprocating components.

3. An engine as in claim 1 wherein said reversing drive includes a pair of gears including a drive gear rotatable with the second sprocket and a driven gear carried on the second balance shaft and driven by engagement with the drive gear.

4. An engine as in claim 1 wherein said gears are carried by a mounting plate on fixed centers and the mounting plate is made of a ferrous material similar to the gears to maintain a relatively constant gear backlash at varying operating temperatures.

5. An engine as in claim 1 wherein said second balance shaft balance weights are maintained below a critical mass polar moment of inertia to avoid gear tooth mismotion and rattle during operation in the range of engine speeds.

6. An engine as in claim 5 wherein the balance weights of the second balance shaft are longer and of smaller diameter than the balance weights of the first balance shaft to provide the lower polar moment of the second balance shaft, the first balance shaft having larger diameter weights and being shorter then the second balance shaft to minimize the space occupied by the first balance shaft.

7. An engine as in claim 1 including a chain tensioner engaging the chain to control chain motion during engine operation.

8. An engine as in claim 1 wherein the chain, driven sprockets and gear components are mounted on a rear wall of the engine frame and the drive sprocket is carried adjacent a rear end of the crankshaft.

* * * * *